US010076712B2

(12) United States Patent
Jamele et al.

(10) Patent No.: US 10,076,712 B2
(45) Date of Patent: Sep. 18, 2018

(54) SYSTEMS AND METHODS FOR FLUID DELIVERY IN SEAT SYSTEMS

(71) Applicant: MediaMation, Inc., Torrance, CA (US)

(72) Inventors: Daniel Robert Jamele, Redondo Beach, CA (US); Takayoshi Kawakami, Tustin, CA (US); Jordan Wolf Ryle, Los Angeles, CA (US); Ryan Adam Boda, Los Angeles, CA (US); Robert Bryce Minden Welborn, Los Angeles, CA (US)

(73) Assignee: MediaMation, Inc., Torrance, CA (US)

( * ) Notice: Subject to any disclaimer, the term of this patent is extended or adjusted under 35 U.S.C. 154(b) by 241 days.

(21) Appl. No.: 14/935,334

(22) Filed: Nov. 6, 2015

(65) Prior Publication Data

US 2017/0127835 A1 May 11, 2017

Related U.S. Application Data

(63) Continuation-in-part of application No. 14/484,196, filed on Sep. 11, 2014, now Pat. No. 9,307,841.

(51) Int. Cl.

| | |
|---|---|
| ***A63J 25/00*** | (2009.01) |
| ***A47C 1/12*** | (2006.01) |
| ***A47C 7/54*** | (2006.01) |
| ***A63G 31/00*** | (2006.01) |
| ***B05B 1/00*** | (2006.01) |

(Continued)

(52) U.S. Cl.

CPC ..... *A63J 25/00* (2013.01); *A47C 1/12* (2013.01); *A47C 7/54* (2013.01); *A47C 7/62* (2013.01); *A63G 31/00* (2013.01); *A63G 31/007* (2013.01); *B05B 1/005* (2013.01); *B05B 1/32* (2013.01); *B05B 12/02* (2013.01); *A63J 5/025* (2013.01); *A63J 2005/002* (2013.01);

(Continued)

(58) Field of Classification Search

CPC ..... A47C 1/12; A47C 7/62; B63J 25/00
USPC ..... 297/452.41
See application file for complete search history.

(56) References Cited

U.S. PATENT DOCUMENTS

| | | | |
|---|---|---|---|
| 2,562,959 | A | 8/1951 | Stern |
| 2,905,049 | A | 9/1959 | Laube |

(Continued)

FOREIGN PATENT DOCUMENTS

| | | |
|---|---|---|
| CN | 203253180 | 10/2013 |
| CN | 2018062802185410 A1 | 7/2018 |

(Continued)

*Primary Examiner* — Anthony D Barfield
(74) *Attorney, Agent, or Firm* — Robert Moll

(57) ABSTRACT

The present invention relates to systems and methods of delivering fluid from one or more armrests of seat systems. In a feature, the system includes a seat support assembly with armrests with one or more fluid nozzles mounted on one or more of the armrests, a fluid delivery system coupled to the one or more fluid nozzle(s), wherein the fluid nozzles are mounted on an end of the armrest that slopes upward to direct fluid toward the viewer. In another feature, the system includes a seat support assembly with air outlet(s) on an armrest coupled to a fan, which reduces the load on the fluid delivery system. In another feature, the system includes a controller (e.g., a network server) configured to communicate on and off commands that correspond to events on a timeline of a movie to actuate the fluid delivery system to deliver fluids to the outlets.

13 Claims, 12 Drawing Sheets

(51) Int. Cl.

| | |
|---|---|
| ***B05B 1/32*** | (2006.01) |
| ***B05B 12/02*** | (2006.01) |
| ***A47C 7/62*** | (2006.01) |
| *A63J 5/02* | (2006.01) |
| *A63J 5/00* | (2006.01) |

(52) U.S. Cl.
CPC .... *A63J 2005/003* (2013.01); *A63J 2005/005* (2013.01); *A63J 2005/008* (2013.01)

(56) References Cited

U.S. PATENT DOCUMENTS

| | | | | |
|---|---|---|---|---|
| 3,628,829 | A | | 12/1971 | Hellig |
| 4,431,183 | A | | 2/1984 | Reimann |
| 5,807,177 | A | | 9/1998 | Takemoto |
| 5,832,320 | A | | 11/1998 | Wittek |
| 5,913,568 | A | | 6/1999 | Brightbill et al. |
| 5,963,302 | A | * | 10/1999 | Wittek ..... A61L 9/125 352/38 |
| 6,152,829 | A | | 11/2000 | Jaidka |
| 6,224,491 | B1 | | 5/2001 | Hiromi |
| RE40,591 | E | | 12/2008 | Denyer |
| 7,691,002 | B2 | | 4/2010 | Casey |
| 7,934,773 | B2 | | 5/2011 | Boulais et al. |
| 7,971,805 | B2 | | 7/2011 | Nolte et al. |
| 8,827,709 | B1 | | 9/2014 | Gurule et al. |
| 9,307,841 | B2 | | 4/2016 | Jamele |
| 2006/0113400 | A1 | | 6/2006 | Dodson |
| 2006/0135271 | A1 | | 6/2006 | Casey |
| 2007/0138660 | A1 | | 6/2007 | Guo |
| 2007/0278331 | A1 | | 12/2007 | Hansson |
| 2010/0205867 | A1 | | 8/2010 | Park |
| 2011/0319180 | A1 | | 12/2011 | Lee |
| 2013/0264396 | A1 | | 10/2013 | Roe |
| 2014/0030974 | A1 | | 1/2014 | D'Angelo et al. |

FOREIGN PATENT DOCUMENTS

| | | | |
|---|---|---|---|
| EP | 0106786 | A1 | 4/1984 |
| EP | 2623172 | A1 | 8/2013 |
| EP | 15840370.9 | A1 | 6/2018 |
| JP | 5115519 | A1 | 5/1993 |
| WO | WO 2013/115477 | A1 | 8/2013 |
| WO | PCT/US2015/43850 | A1 | 8/2015 |
| WO | PCT/AT2015/050137 | | 12/2015 |
| WO | PCT/US2015/043850 | | 1/2016 |
| WO | PCT/US2016/60409 | | 5/2017 |

* cited by examiner

SYSTEMS AND METHODS FOR FLUID DELIVERY IN SEAT SYSTEMS

BACKGROUND

This application is a continuation-in-part of U.S. application Ser. No. 14/484,196, which is incorporated by reference herein, and filed on Sep. 11, 2014.

The present invention relates to systems and methods of fluid delivery for effects for a viewer in a seat system.

Disney's Star Tours and Universal Studio's The Simpsons Ride, commercial movie theaters, gaming environments, and training centers (e.g., military, law enforcement, and flight schools) use effects to produce the sensation that one is immersed in the reality displayed on a movie screen.

A motion effect is implemented by synchronizing the seat motion of the viewer to correspond to the displayed scenes. The motion seat systems can be adapted to receive motion signals that move seats to correspond (e.g., synchronize) to other signals (e.g., video and/or audio signals) that are perceived by person(s). For example, the seat system may synchronize seat motions with the displayed motions in a theater to simulate the forces one would experience seated in a vehicle in a chase scene where the vehicle races around a city street.

Another effect is to deliver fluids such as a water mist, a blast of air, wind, and one or more scents to the viewer with the displayed scenes. For example, a system may deliver an orange scent to the viewer while movie displays a character traveling through an orange orchard, deliver a water mist to the viewer when the character travels through a rainy jungle or wind in a storm scene. To the inventors' awareness, the wind effect is implemented by fans hanging in a theater, but this may distract from the viewer's experience and may be noisy. The water mist and scents have been implemented by installing nozzles in a front rail in front of a row of seats or installing the nozzles into the back of the seats in front of the viewers, but either approach is expensive to implement and not practical because the motion of the seats affects the directionality of the fluid delivery. In short, the motion seats may move the viewer out of the path of fluid delivery.

SUMMARY OF THE INVENTION

The present invention relates to systems and methods of fluid delivery for effects for a viewer in a seat system.

In a feature, the system includes a seat support assembly, one or more seats on the seat support assembly, including one or more armrests, an air nozzle on one of the armrests, and a fluid delivery system including a controllable valve array including an air inlet, a high flow air outlet, a low flow air outlet, a first scent outlet, a high flow air line connected from the high flow air outlet through a high flow air regulator to a first fluid line, a low flow air line connected from the low flow air outlet through a low flow air regulator to the first fluid line, and a first scent line connected from the first scent outlet through a first scent flow regulator and a first scent tank to the first fluid line, wherein the first fluid line is coupled to the air nozzle.

In another feature, the valve array further includes a second scent outlet, wherein a second scent line is connected from the second scent outlet through a second scent flow regulator and a second scent tank to the first fluid line coupled to the air nozzle.

In another feature, the system further includes a water nozzle on the one of the armrests, and a water valve with a water inlet and a water outlet, wherein a water line is connected from the water outlet to a second fluid line coupled to the water nozzle.

In still another feature, the valve array further includes an atomizing air outlet, an atomizing air line connected from the atomizing air outlet through an atomizing air flow regulator to the water nozzle, wherein the water nozzle is adapted to deliver atomized water when the valve for the atomizing air outlet and the water valve are open.

In another feature, the system includes a seat support assembly with air outlet(s) on an armrest coupled to a fan, which reduces the load on a fluid delivery system.

In yet another feature, a controller is configured to communicate on and off commands that correspond to events on a timeline of a movie to actuate one or more of the valves of the valve array to deliver fluids to the nozzles.

In still another feature, the system further includes a shut-off valve on the water line downstream from the water valve.

In another feature, the system includes a seat support assembly, one or more seats on the seat support assembly, including one or more armrests, and one or more fluid nozzles mounted on the one or more armrests, a fluid delivery system, including an air inlet, a high flow air outlet, a high flow air line connected from the high flow air outlet through a high flow air regulator to a first fluid line, a low flow air outlet, a low flow air line connected from the low flow air outlet, through a low flow air regulator, to the first fluid line coupled to the air nozzle.

In another feature, the system further includes a shut off valve on the water line downstream from the water valve.

In an additional feature, the air flow regulators can be replaced by pressure regulators. In still another feature, the flow regulators and/or the pressure regulators can be omitted. In yet another feature, the air flow regulators or the pressure regulators, can be positioned anywhere along their respective air lines or can be positioned upstream from the air inlet.

In another feature, the system includes a controller configured to communicate on and off commands that correspond to events on a timeline of a movie to actuate one or more of the valves of the valve array to deliver fluids to the nozzles.

In a feature, the method of fluid delivery to a viewer in a seat system includes providing nozzles, on seat armrests, coupled to a fluid delivery system, and communicating commands from a controller, wherein the commands are associated with events on a movie timeline, adapted to actuate the fluid delivery system to deliver fluids to the nozzles and/or fans.

In another feature, the system includes a seat support assembly with air outlet(s) on an armrest coupled to a fan, which reduces the load on the fluid delivery system.

DETAILED DESCRIPTION OF THE PREFERRED EMBODIMENTS

The following description includes the best mode of carrying out the invention. The detailed description is made for the purpose of illustrating the general principles of the invention and should not be taken in a limiting sense. The scope of the invention is determined by reference to the claims. Each part is assigned its own part number throughout the specification and drawings.

Figure 1:
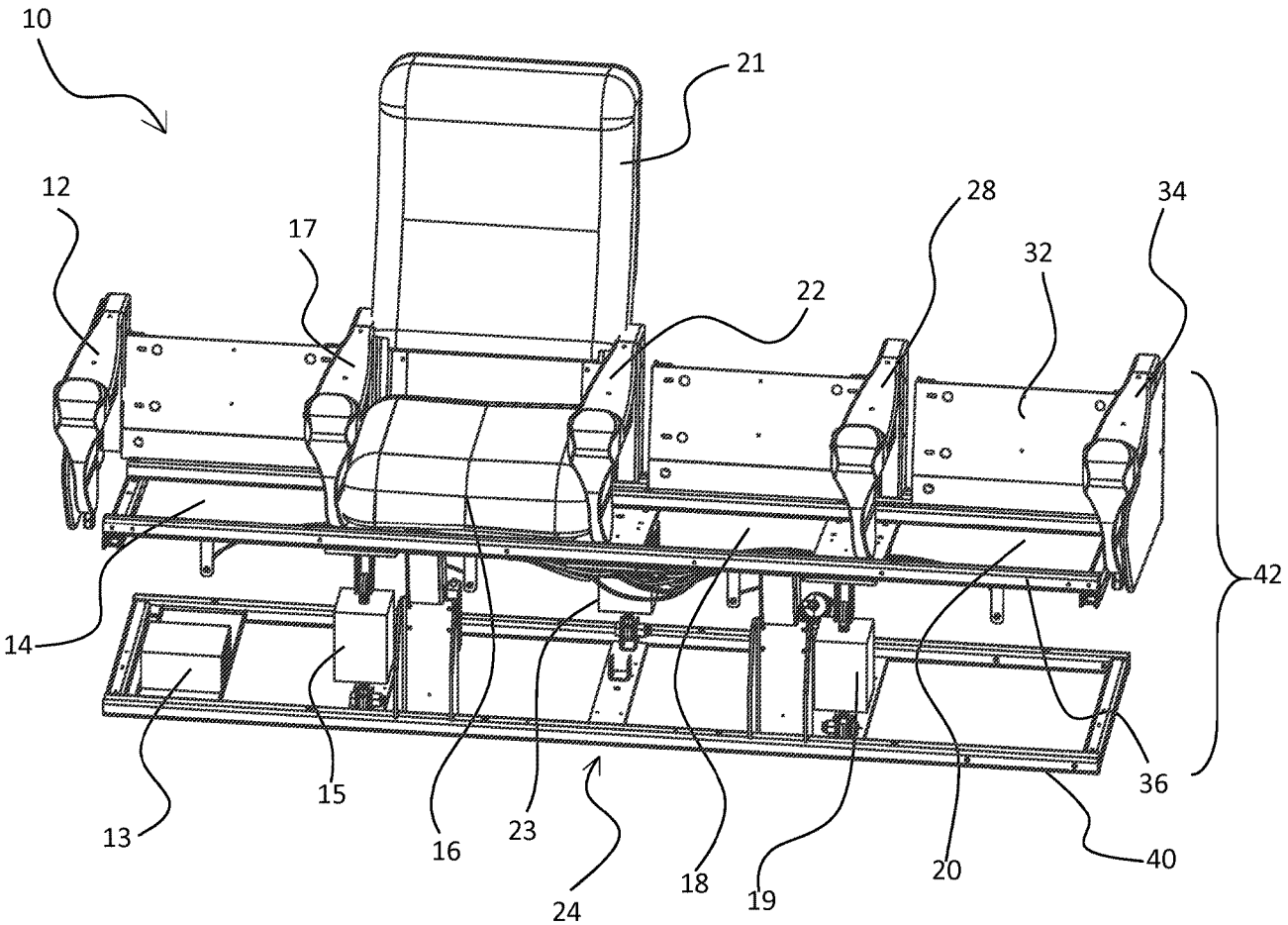
FIG. 1 illustrates a seat support assembly that is useful for the system.

FIG. 1 illustrates a seat support assembly that is suitable for the system. In this embodiment, the system 10 includes a seat support assembly 42 that includes a top frame 36 and a bottom frame 40. Front actuators 15 and 19 and a back actuator 23 provide structural support between the top and bottom frames 36 and 40. The actuators also provide motion to the seat support assembly 42. U.S. Pat. No. 8,585,142 B2 to Jamele et al., Motion Seat Systems and Methods of Implementing Motion in Seats, which is incorporated by reference herein, describes motion seat systems that are suitable with the systems.

FIG. 1 also illustrates that in an embodiment a seat frame 32 is secured (e.g., bolted and welded) to the top frame 36. The seat frame 32 has four spaces 14, 16, 18, and 20 for the seats. Armrests 12, 17, 22, 28, and 34 are secured (e.g., bolted and welded) to the seat frame 32. A seat 21 in space 16 illustrates how the other seats (not shown) fit and are secured in spaces 14, 16, 18, and 20 on the seat support assembly 42.

Figure 5:
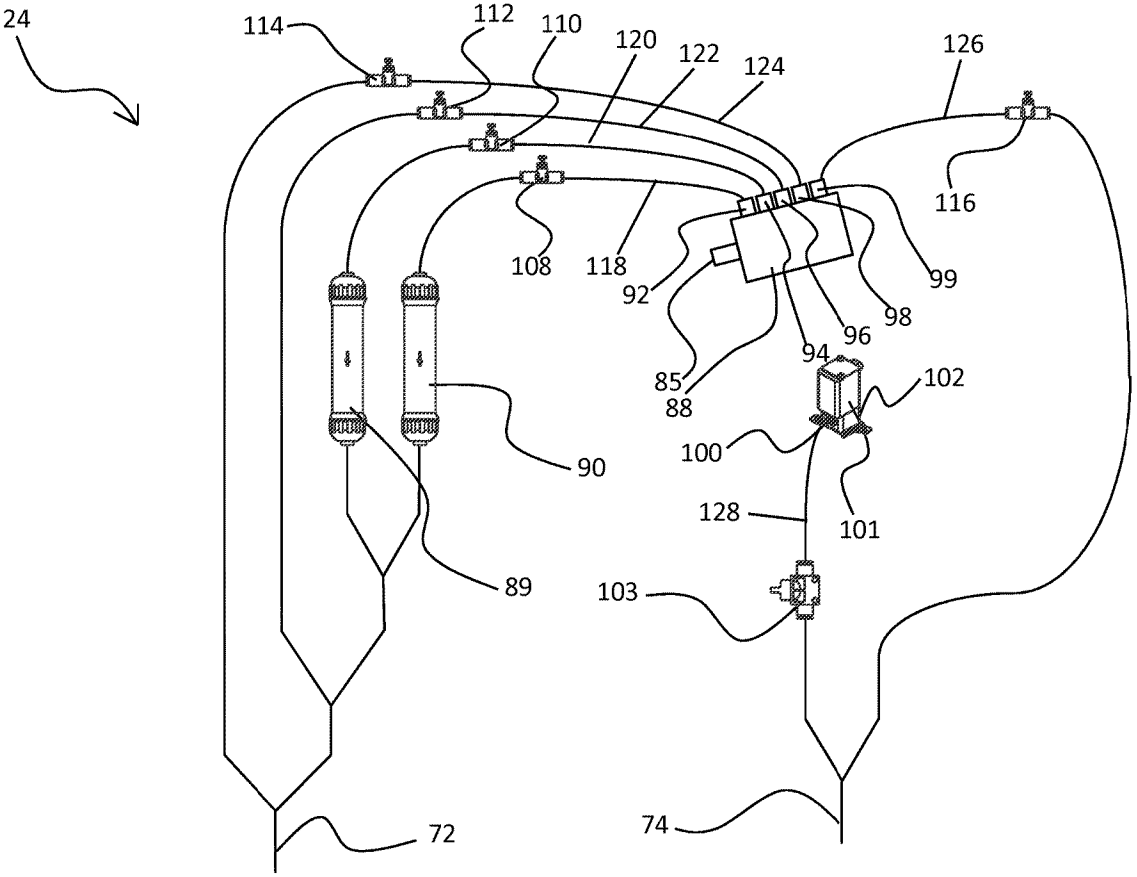
FIG. 5 illustrates an embodiment of the fluid delivery system used to distribute water, air, and/or scent(s) to the respective nozzles.
Figure 6:
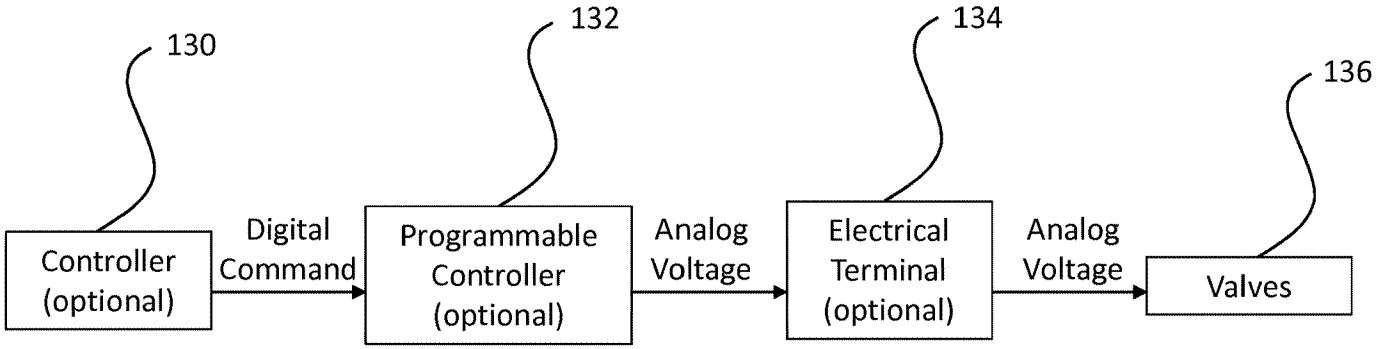
FIG. 6 illustrates a flowchart and hardware for control of the fluid delivery system.

In an embodiment, the seat support assembly 42 contains space for a fluid delivery system 24 (shown in FIG. 5) and a programmable controller 13. FIGS. 5-6 and the accompanying specification will describe both in detail.

Figure 2:
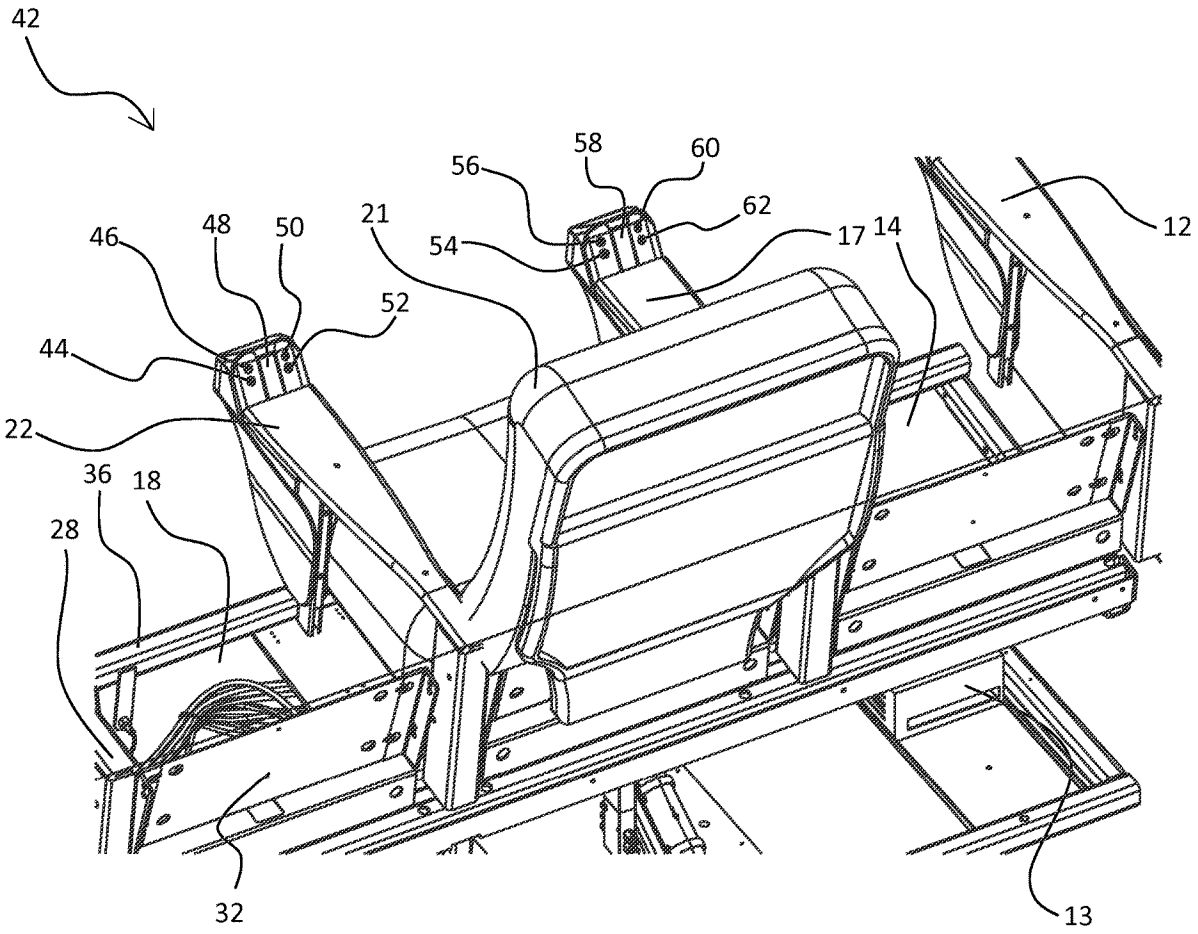
FIG. 2 illustrates a back view of the system of FIG. 1.

FIG. 2 illustrates a back side view of the system shown in FIG. 1. As shown, the armrest 22 includes a set of nozzles 44, 46, 50, and 52 that reside in holes in a sloped plate 48 at the end of armrest 22. The nozzles 50 and 52 will be used to distribute fluids such as air, water, and/or scents to a viewer in seat 21, while the nozzles 44 and 46 will be used to distribute fluids such as air, water, and/or scents to a viewer in a seat (not shown) that will occupy space 18. A suitable water nozzle is the Hago water nozzle MW5 that can be obtained from the Hago Manufacturing in Mountainside, N.J. A suitable air nozzle is the SMC muffler ASP-2 that can be obtained from SMC in Noblesville, Ind. This fluid distribution will be described in detail in connection with FIGS. 4A-5.

Similarly, the armrest 17 includes a set of nozzles 54, 56, 60, and 62 that reside in holes in a sloped plate 58 at the end of the armrest 17. The nozzles 54 and 56 will be used to distribute fluids such as air, water, and/or scents to a viewer in the seat 21, while the nozzles 60 and 62 will be used to distribute fluids such as air, water, and/or scents to a viewer in a seat (not shown) that will occupy space 14.

Figure 3:
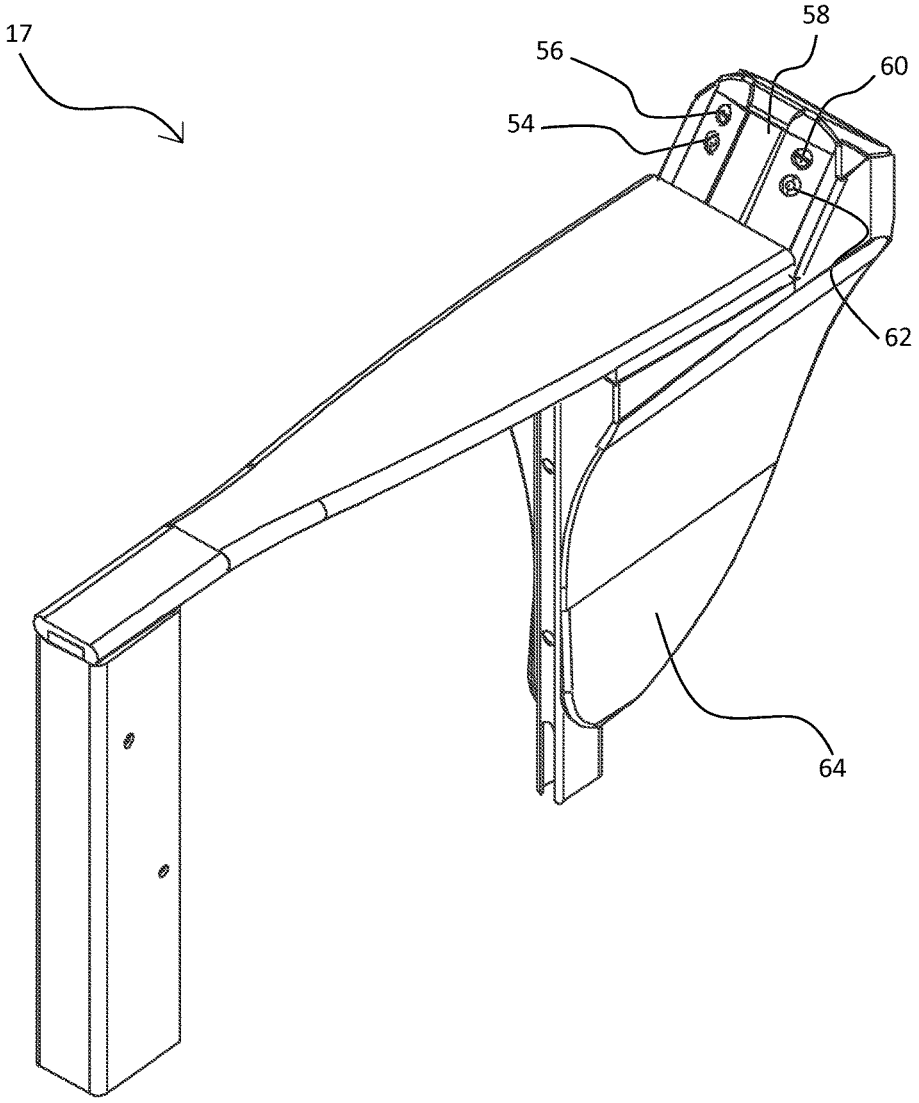
FIG. 3 is an external view of the armrest apart from the seat support assembly.

FIG. 3 is an external view of the armrest 17 apart from the seat support assembly 42 (FIGS. 1-2). A cover 64 adjacent to or integral with the nozzle plate 58 is a protective enclosure for the nozzles 54, 56, 60, and 62 and their respective fluid lines. A suitable fluid line is plastic tubing such as Festo PUN-6x1 plastic tubing from Festo in Esslingen am Neckar, Germany.

Figure 4B:
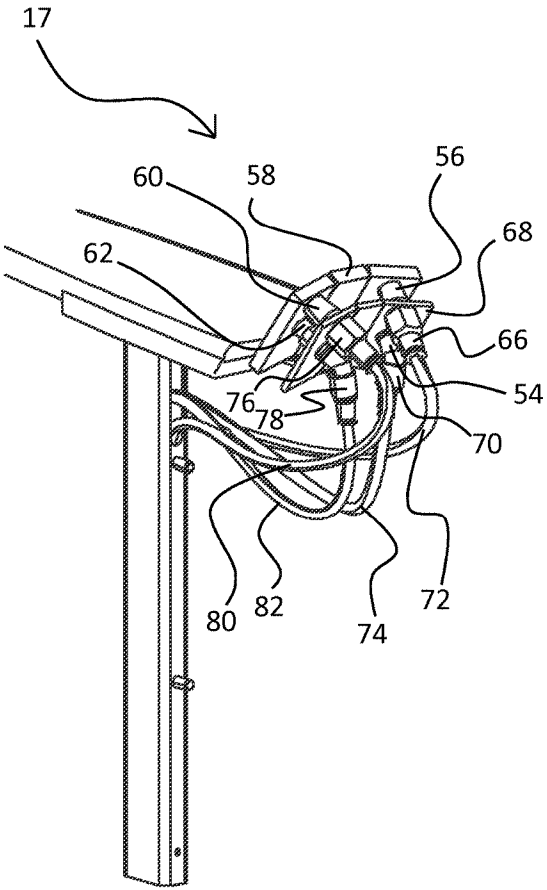
FIG. 4B is a view with the front cover of the armrest removed to show the nozzles secured to the plates.
Figure 4A:
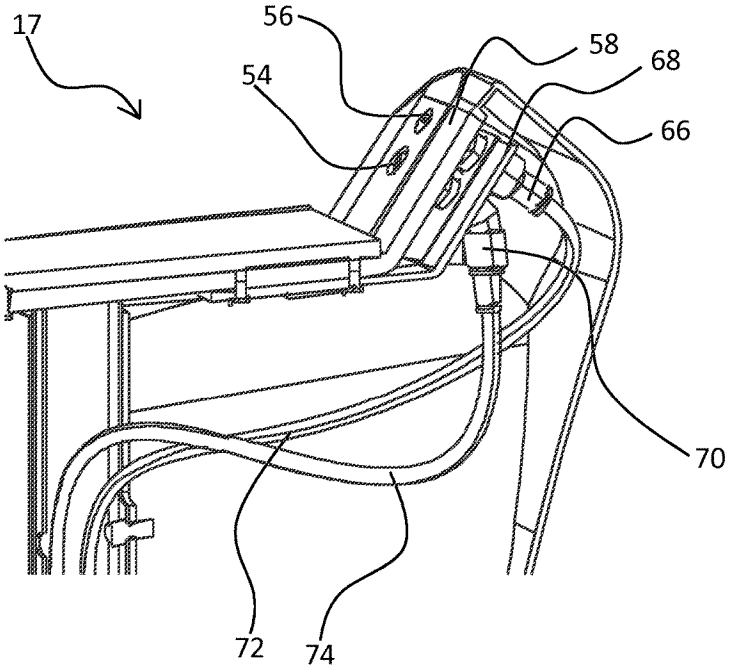
FIG. 4A is an internal view of the armrest that illustrates the nozzles and the nozzle plates.

FIG. 4A is an internal view of the armrest shown in FIG. 3. The cover 64 of armrest 17 is partly removed to reveal that the nozzles 54 and 56 residing in nozzle plate 58 are secured to the mounting plate 68 and coupled to nozzle fittings 66 and 70, which in turn are coupled to a first fluid line 72 and a second fluid line 74. A suitable water nozzle fitting is the SMC KQ2K06-01AS and a suitable air nozzle fitting is the SMC KQ2F07-35, both from SMC in Noblesville, Ind.

FIG. 4B is an internal view of the components in the armrest. The front cover 64 is fully removed from armrest 17 to reveal that the nozzles 54, 56, 60 and 62 are secured to the mounting plate 68 and are coupled to the nozzle fittings 66, 70, 76, and 78, which in turn are coupled to the fluid lines 72, 74, 80, and 82.

FIG. 5 illustrates an embodiment of a fluid delivery system that can be used to distribute water, air, and scents to the nozzles shown in FIGS. 2-4B.

As illustrated, the fluid delivery system 24 includes a valve array 88. A suitable valve array can be assembled from Festo valve manifold VABM-L1-14S-G14-5 and Festo valves VUVG-L14-T32C-AT-G18-1P3, which can be obtained from Festo, Esslingen am Neckar, Germany. The valve array includes an air inlet 85, a high flow air outlet 98, a low flow air outlet 96, a first scent outlet 94, a second scent outlet 92, and/or an air outlet 99.

An air supply source (e.g., an air compressor at 100 psi, not shown), supplies air to the air inlet 85. In an embodiment, a high flow air line 124 is connected from the air outlet 98 through a high flow air regulator 114 to the fluid line 72. A low flow air line 122 is connected from the air outlet 96 through a low flow air regulator 112 to the fluid line 72. A first scent line 120 is connected from the air outlet 94 through a first scent flow regulator 110 and a first scent tank 89 to the fluid line 72. A second scent line 118 is connected from the air outlet 92 through a second scent flow regulator 108 and a second scent tank 90 to the fluid line 72. As a result, the first fluid line 72 is able to deliver high air flow (e.g., air blast), a low air flow (e.g., wind), and scent(s)(e.g., freshly cut grass) through a single air nozzle 56 (FIG. 4B). A suitable flow regulator is the SMC AS2051FG-08 Inline Flow Control from SMC in Noblesville, Ind. A suitable scent tank is the Clear Inline DI Filter Cartridge 214 that can be obtained from Filter Direct in Santa Ana, Calif. A suitable scent source is the Scent Sleeve from Escential Resources FX from Torrance, Calif.

In additional embodiments, the air flow regulators 108, 110, 112, 114, and 116 can be replaced by pressure regulators. A suitable pressure regulator is the SMC AW30-N03-Z Filter Regulator from SMC in Noblesville, Ind. In another embodiment, the air flow regulators 108, 110, 112, 114 and/or 116 and/or the pressure regulators can be omitted. In other embodiments, the air flow regulators 108, 110, 112, 114, and 116, or the pressure regulators, can be positioned anywhere along their respective air lines 118, 120, 122, 124, and 126, or can be positioned upstream from the air inlet 85.

A water pump (not shown), e.g., 30-70 psi, supplies water to the water inlet 102 of the water valve 101, which couples the water line 128 from the water outlet 100, through a shut-off valve 103, to the fluid line 74. An atomizing air line 126 is coupled to the air outlet 99 and to an air flow regulator 116. The atomizing air line 126 is coupled to the fluid line 74. As a result, the fluid line 74 is able to deliver a fine spray of atomized water (e.g., mist) and/or water through a single water nozzle 56 (FIG. 4B). When the atomized water is delivered both the air outlet 99 and the water valve 101 are opened. A suitable water valve is the SMC water valve VDW22AA from SMC in Noblesville, Ind.

Many of the parts of the systems can be purchased and implemented with high strength steel, but the person of ordinary skill would readily understand the materials and parts to use after review of the specification. Further, the choice of materials and conventional parts is not essential to the invention.

FIG. 6 is a flowchart of the process and hardware transmitting commands from the controller to valves to control the fluid delivery system. In an embodiment, using known conventional techniques, the system can include a controller 130 that transmits a digital command to a programmable controller 132, which in turn transmits an analog voltage to an electrical terminal 134, which in turn sends the analog voltage to the valve array 88 (FIG. 5) and/or the water valve 101, collectively called valves 136, to actuate the valve(s). As indicated in FIG. 6, one or more of the hardware components 130, 132, and 134 can be omitted from the control process. In an alternative embodiment, an operator will manually actuate the valves 136 to achieve the desired effects.

Figure 7:
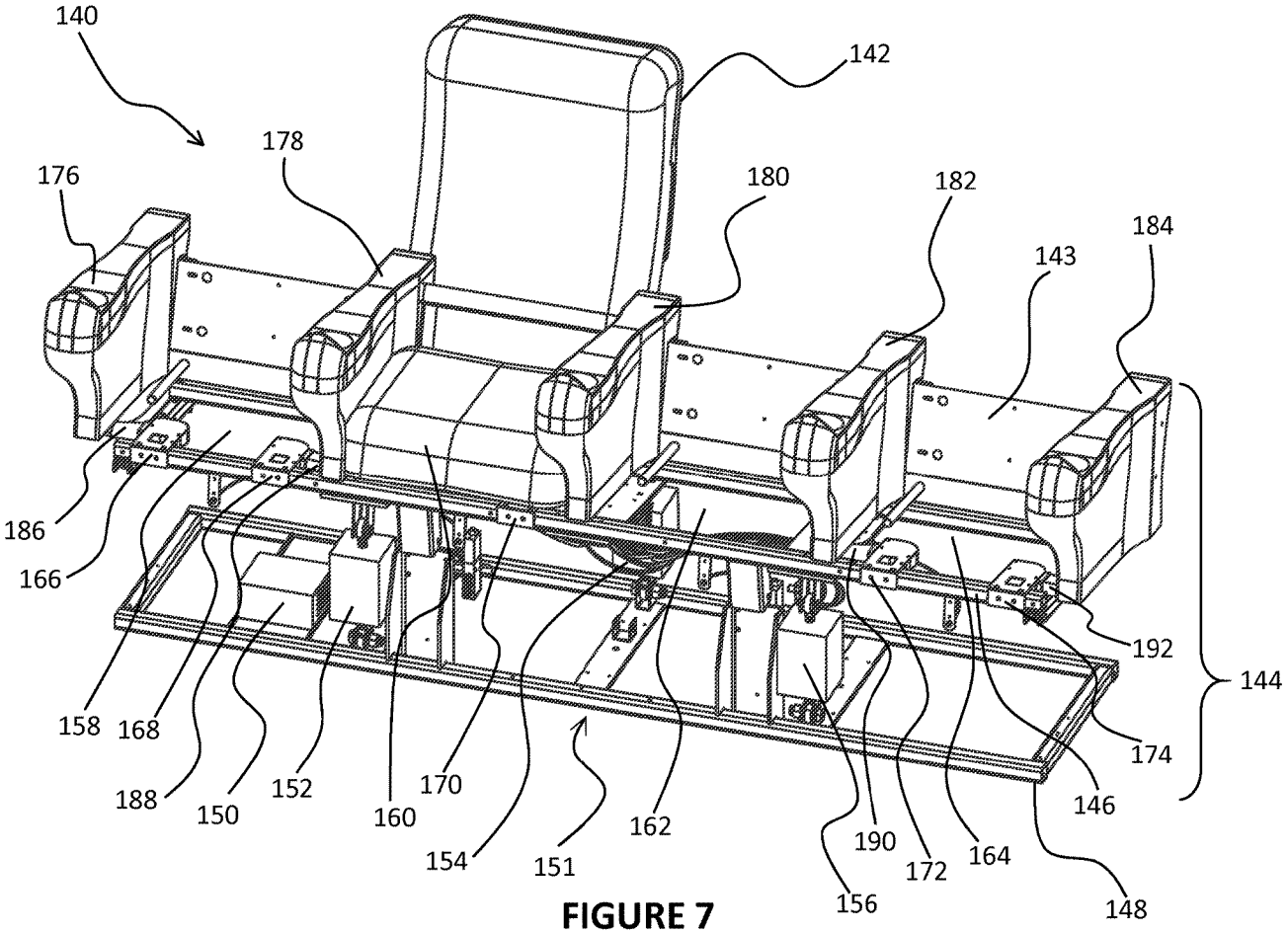
FIG. 7 illustrates another embodiment of the seat support assembly.

FIG. 7 illustrates another embodiment of the system. In this embodiment, a system 140 has a seat support assembly 144 that includes a top frame 146 and a bottom frame 148. A set of front actuators 152 and 156 and a back actuator 154 provide structural support between the top and bottom frames 146 and 148. The actuators provide motion to the seat support assembly 144. U.S. Pat. No. 8,585,142 B2 to Jamele et al., Motion Seat Systems and Methods of Implementing Motion in Seats, which is incorporated by reference herein, describes motion seat systems that are suitable for use in the system.

FIG. 7 illustrates a seat frame 143 secured (e.g., bolted and welded) to the top frame 146. The seat frame 143 has four spaces 158, 160, 162, and 164, which will be occupied by seats. A seat 142 in space 160 illustrates how the other seats (not shown) fit within spaces 158, 162, and 164 of the seat support assembly 144.

In this embodiment, armrests 176, 178, 180, 182, and 184 are secured (e.g., bolted and/or welded) to the seat frame 143. A fan to tube adapter 186 is secured (e.g., bolted and/or welded) to a fan and fan mount 166 associated with the armrest 176. A fan to tube adapter 188 is secured to a fan and fan mount 168 associated with the armrest 178. The seat 142 rests on the fan and fan mount 170 associated with the armrest 180. A fan to tube adapter 190 is secured to a fan and fan mount 172 associated with the armrest 182. A fan to tube adapter 192 is secured to a fan and fan mount 174 associated with the armrest 184. Although not illustrated in FIG. 7, spaces 158, 162, and 164 will be each occupied with a seat like seat 142 that include at least one armrest with a fan to tube adapter and a fan and fan mount.

Figure 11:
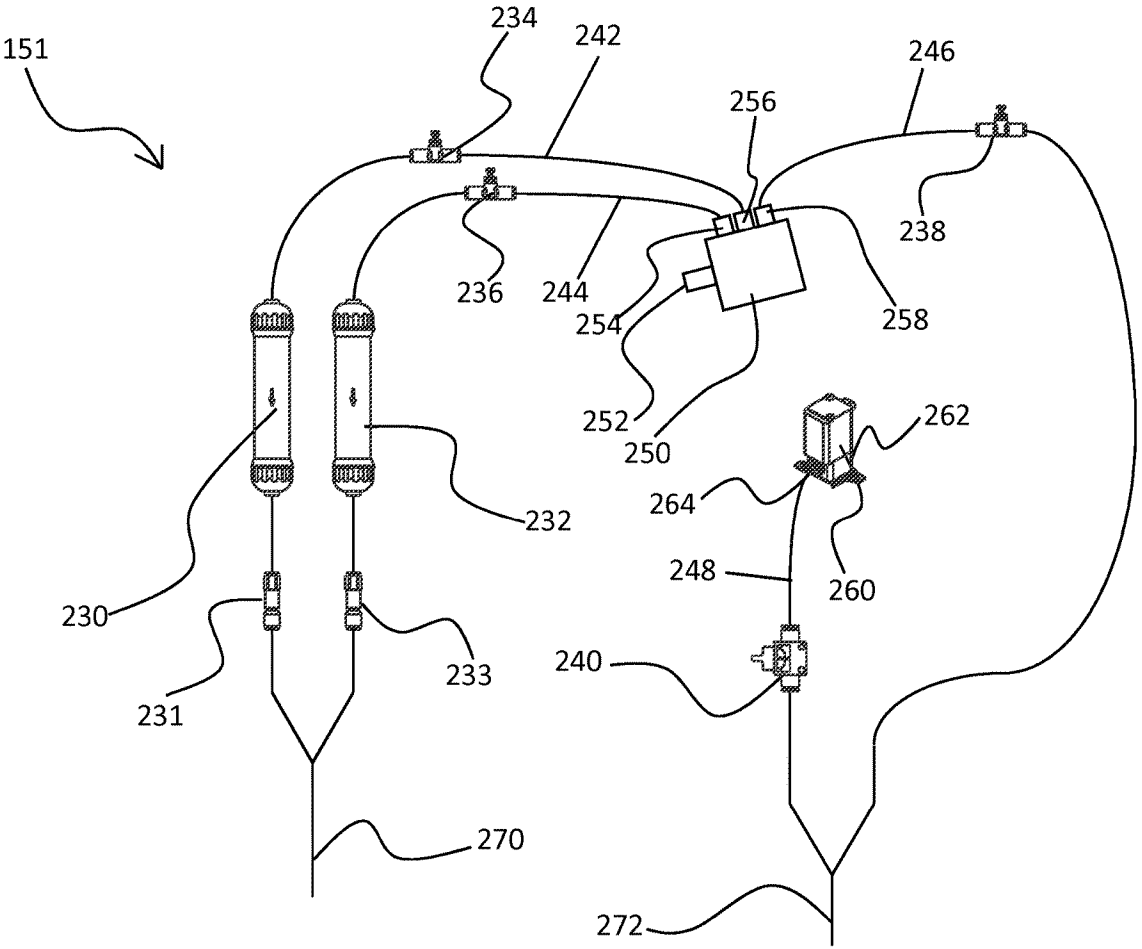
FIG. 11 illustrates an embodiment of the fluid delivery system used to distribute water, air, and/or scent(s) to outlets at the armrests.
Figure 12:
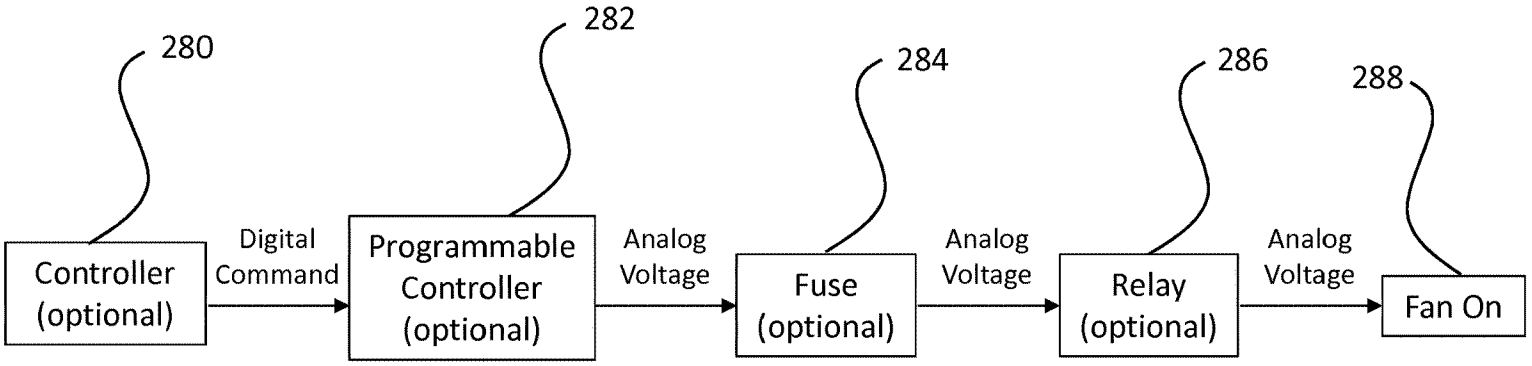
FIG. 12 illustrates a flowchart and hardware for control of the fluid delivery system of FIG. 11.

In the illustrated embodiment, the seat support assembly 144 contains four seats and an associated fluid delivery system 151 (shown in FIG. 11) and a programmable controller 150. However, the number of seats is not essential to the invention. Further, the fluid delivery system 151 and a programmable controller 150 can be used in more than a single seat support assembly as long as the electrical power supply can support it. FIGS. 11-12 and the accompanying specification describe other details of the programmable controller 150 and the fluid delivery system 151.

Figure 8:
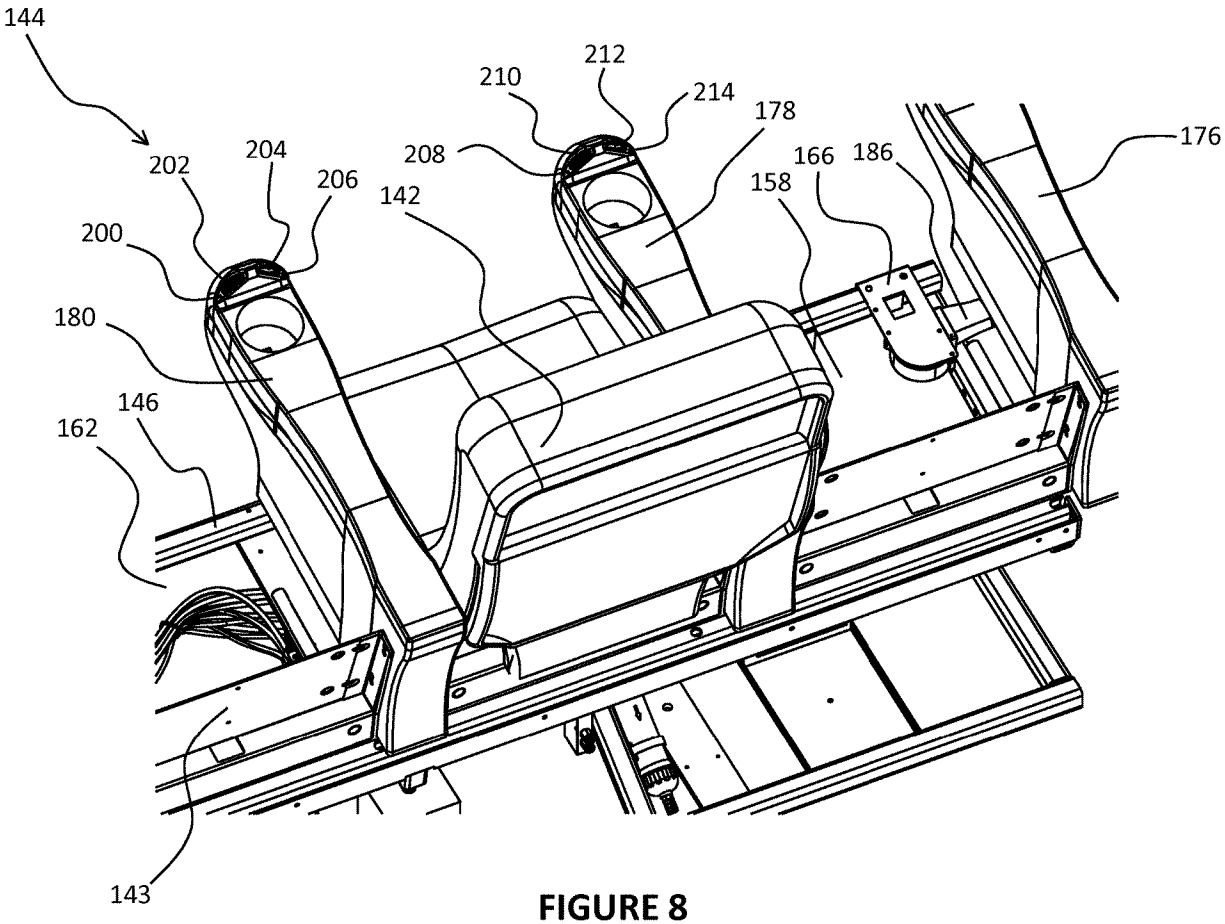
FIG. 8 illustrates a back view of the seat support assembly of FIG. 7.

FIG. 8 illustrates a back view of the seat support assembly of FIG. 7. As shown, the frame assembly 144 includes a seat 142 with armrests 178 and 180. The front end of armrest 180 includes air, scent, and/or water outlets 200 and 206 and air outlets 202 and 204. In an embodiment, the front end of armrest is dome-shaped so that the air outlets 202 and 204 can direct air flow to the viewers on either side of the armrest 180. In another feature, the air outlets 202 and 204 follow the curvature of the dome-shaped end of armrest increasing the cross-sectional area for airflow but remaining narrow enough to prevent debris or trash from entering into the air outlets 202 and 204. Similarly, the front end of the armrest 178 includes air, scent, and/or water outlets 208 and 214 and air outlets 210 and 212. In the illustrated embodiment, the front ends of the armrests 178 and 180 are oriented, slanted, and/or sloped so that the air outlets 204 and 210 direct fluid (e.g., air) and the air, scent, and/or water outlets 206 and 208 direct fluid (e.g., air, scent, and/or water) toward the viewer (not shown) in seat 142.

Further, in the illustrated embodiment, the air, scent, and/or water outlet 200 will be used to distribute fluids (e.g., air, scent, and/or water), and the air outlet 202 will be used to distribute a fluid (e.g., air) to a viewer in a seat (not shown) that would occupy the space 162 defined by the top frame 146 and the seat frame 143. Further, the air, scent, and/or water outlet 214 will be used to distribute fluids (e.g., air, scent, and/or water), and the air outlet 212 will be used to distribute a fluid (e.g., air) to a viewer in a seat that would occupy space 158. Preferably, the fan and fan mount will be in close proximity to the armrest where it delivers air flow. Thus, the fan and fan mount 166 associated with the armrest 176 and the fan to tube adapter 186 is secured (e.g., bolted and/or welded) and adjacent to the armrest 176. However, it is not essential to the invention that the fan and fan mount be adjacent the closest armrest or even provide air flow to a single armrest. Thus, in an alternative embodiment, the fan and fan mount 166 delivers air flow to the armrest 176 and/or armrest 178.

Figure 9B:
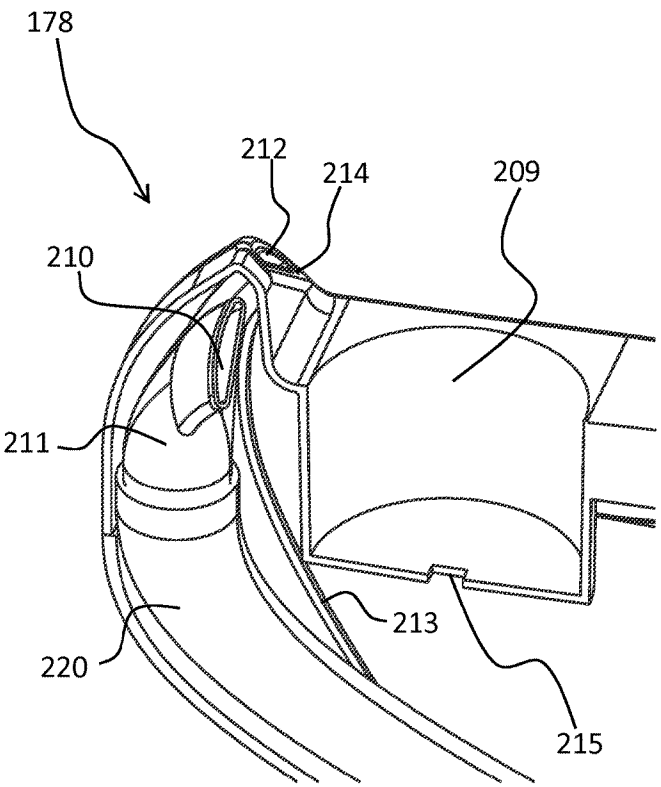
FIG. 9B is an internal view of the armrest. This embodiment illustrates a tube with a Y-splitter connected to the air outlets and a tube connected to an air, scent, and/or water outlet.
Figure 9A:
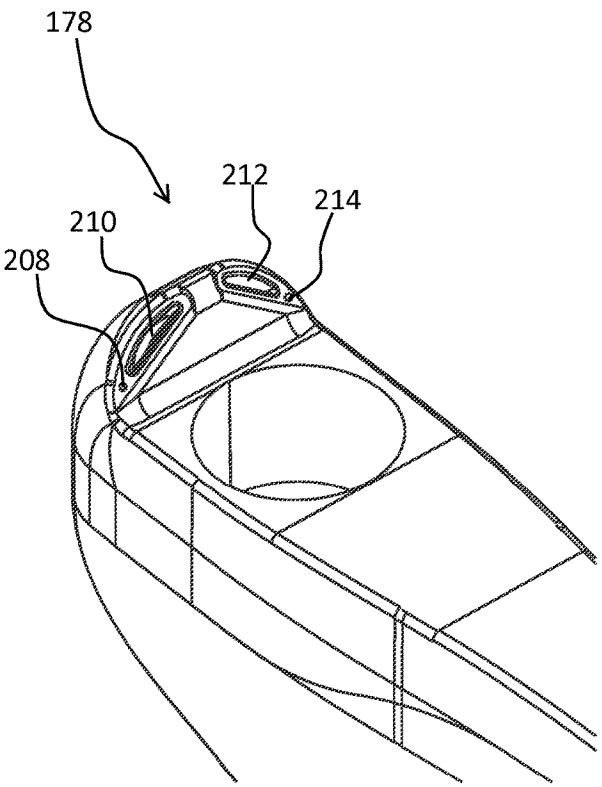
FIG. 9A is an external view of the armrest apart from the seat support assembly of FIG. 7.

FIG. 9A is an external view of the armrest apart from the seat support assembly of FIG. 7. FIG. 9A illustrates that the air, scent, and/or water outlets 208 and 214 are relatively small openings compared to the openings of the air outlets 210 and 212. Thus, outlets 208 and 214 are particularly useful for delivery of compressed fluids. FIG. 11 will illustrate an embodiment of a fluid delivery system that can be used to distribute the air, scent, and/or water to these air, scent, and/or water outlets shown in FIGS. 8 and 9A-9B.

FIG. 9B is an internal view of the front end of the armrest 178 that was shown in FIG. 7. A foam tube 220 with a Y-splitter 211 that is connected to the air outlets 210 and 212. The foam tube 220 is made of sound absorbing material and has a large diameter to reduce resistance to the delivery of air to the viewer. A suitable foam tube for any of the foam tubes such as the foam tube 220 is the Armacell AP Armaflex Pipe Insulation APT11838 that can be obtained from Carrier Enterprise Canada, LP Victoria, BC. A suitable Y-splitter for any of the Y-splitters such as the Y-splitter 211 can be obtained from MediaMation Inc. in Torrance, Calif.

In an alternative embodiment, the foam tube and Y-splitter are a single structure rather than separate structures.

Because the air, scent, and/or water lines are described in connection with FIGS. 4A-4B, we don't illustrate each line (e.g., a tube) connected to the air, scent, and/or water outlets 208 and 214, but show a representative air, scent, and/or water tube 213 that communicates with the air, scent, and/or water outlet 214. The nozzles and tubes used to connect the air and/or water outlets 208 and 214 are same material and construction used in the tubes illustrated in FIGS. 4A-4B and described in the accompanying specification.

Figure 10B:
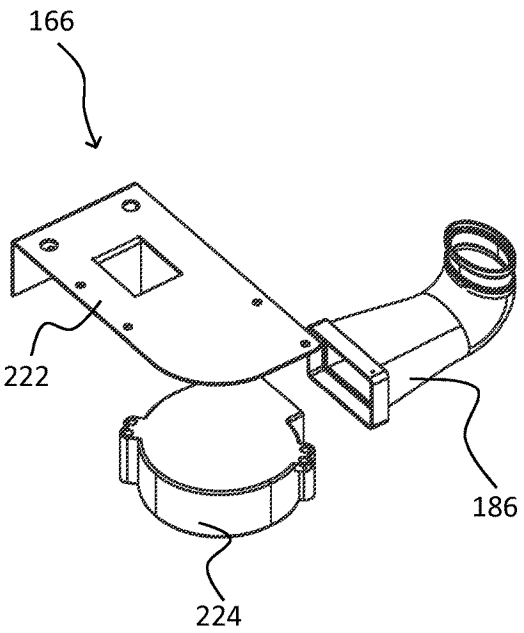
FIG. 10B illustrates an embodiment of a fan, a fan mount, and a fan to tube adapter used in the fluid delivery system.
Figure 10A:
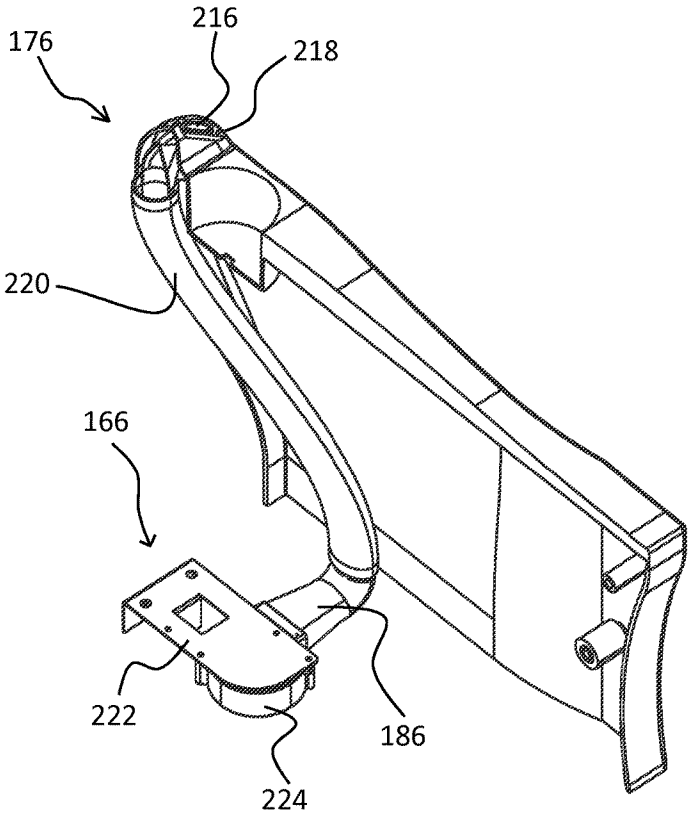
FIG. 10A is an internal view that illustrates an embodiment of the fluid delivery system including a fan coupled to the air outlets of an armrest.

FIG. 10A is an internal view that illustrates an embodiment of the fluid delivery system including a fan system coupled to the air outlets of an armrest. In the embodiment, the armrest 176 has an associated fan 224 secured to a fan mount 222. The fan 224 communicates with or is coupled to a fan to tube adapter 186 that is in turn connected to the foam tube 220. In an embodiment, the foam tube 220 is inside the armrest 176 and coupled to a Y-splitter 211 (FIG. 9B) that opens or is connected to the air outlet 216. In the embodiment, the foam tube 220 has material that absorbs noise and vibration. In addition, the physical separation of the fan 224 from the armrest 176 and seat (not show) effectively provide noise and fan vibration isolation from the viewers.

FIG. 10B illustrates an embodiment of a fan system, including a fan, a fan mount, and a fan to tube adapter. In an embodiment, the fan system is an independent source of air than the air delivered by the fluid delivery system of FIG. 11. FIG. 10B is an exploded view of the fan and fan mount 166 that includes the fan 224 secured (e.g., using machine screws of welding) to a L-shaped fan and the fan mount 222 made of steel and secured by welding or screws or bolts to the front of the top frame 146 (FIG. 7). In an embodiment, the fan mount 222 has a cut out bent 90 degrees downward to provide an additional surface adjacent to the top frame 146. The output of the fan 224 is secured with a conventional clamp or frictionally fit to the fan to tube adapter 186. The fan to tube adapter 186 is J-shaped and secured with a conventional clamp or frictionally fit inside or outside the end of the foam tube 220 (FIG. 10A).

A suitable fan mount for any of the fan mounts such as the fan mount 222 can be obtained from MediaMation Inc. in Torrance, Calif. A suitable fan for any of the fan such as fan 224 is the Sanyo Denki San Ace 9BMB245S201 that can be obtained from Sanyo Denki in Torrance, Calif. A suitable fan to tube adapter for any of the fan to tube adapters such as fan to tube adapter 186 can be obtained from MediaMation Inc. in Torrance, Calif.

FIG. 11 illustrates an embodiment of the fluid delivery system used to distribute water, air, and/or scent(s) to outlets at the armrests. The fluid delivery system is used to distribute water, air, and/or scent(s) to air, scent, and/or water outlets 200, 206, 208 and 214 (FIGS. 8 and 9A-9B).

As illustrated, the fluid delivery system 151 includes a valve array 250. A suitable valve array can be assembled from Festo valve manifold VABM-L1-14S-G14-5 and Festo valves VUVG-L14-T32C-AT-G18-1P3, which can be obtained from Festo, Esslingen am Neckar, Germany. The valve array 250 includes an air inlet 252, an air valve outlet 254, an air valve outlet 256, and an air valve outlet 258.

An air supply source (not shown), for example, an air compressor at 100-125 psi supplies air to the air inlet 252. A first air line 242 is connected from the air valve outlet 256 through a first flow regulator 234 and a first scent tank 230 through a check valve 231 to the air nozzle outlet 270. A second air line 244 is connected from the air valve outlet 254 through a second flow regulator 236 and a second scent tank 232 through a check valve 233 to the air nozzle outlet 270. The first flow regulator 234 controls the flow rate of first scent delivered to the viewer. The second flow regulator 236 controls the flow rate of second scent delivered to the viewer. The first check valve 231 prevents upstream contamination of the first scent tank 230 and the second check valve 233 prevents upstream contamination of the second scent tank 232. A suitable check valve is the AKH08-00 from SMC in Noblesville, Ind. A suitable flow regulator is the SMC AS2051FG-08 Inline Flow Control from SMC in Noblesville, Ind. A suitable scent tank is the Clear Inline DI Filter Cartridge 214 that can be obtained from Filter Direct in Santa Ana, Calif. A suitable scent source is the Scent Sleeve from Escential Resources FX from Torrance, Calif. In an embodiment, the scent tanks provide scent to each seat of the seat assembly, and can be readily replaced to match the scent requirements of a given movie.

As a result, the air nozzle outlet 270 delivers air and scent to air, scent, and/or water outlets 200, 206, 208 and 214 (FIGS. 8 and 9A-9B). For example, the air nozzle outlet 270 can deliver high air flow (e.g., air blast), a low air flow (e.g., wind), and scent(s)(e.g., the smell of oranges) through, e.g., the air outlet 208 and/or air outlet 212 (FIG. 9A).

In additional embodiments, the flow regulators 234 and 236 can be replaced by pressure regulators. A suitable pressure regulator is the SMC AW30-N03-Z Filter Regulator from SMC in Noblesville, Ind. In another embodiment, the air flow regulator 234 and/or the air flow regulator 236 and the scent tanks can be omitted. In other embodiments, the flow regulator 234 and/or the flow regulator 236, or the pressure regulators, can be positioned anywhere along their respective air lines 242 and 244 and can be even positioned upstream from the air inlet 252.

A water pump (not shown), e.g., 30-70 psi, supplies water to the water inlet 262 of the water valve 260, which couples the water line 248 from the water outlet 264 through a thumb valve 240 to the air and/or water nozzle outlet 272. An atomizing air line 246 is coupled to the air valve outlet 258 and to a flow regulator 238. The atomizing air line 246 is coupled to the air and/or water nozzle outlet 272. As a result, the air and/or water outlet 272 is able to deliver a fine spray of atomized water (e.g., mist) and/or water through one or more air and/or water outlets 200, 206, 208 and 214 (FIGS. 8 and 9A-9B). When the atomized water is delivered both the air outlet 258 and the water valve 260 are opened. A suitable water valve is the SMC water valve VDW22AA from SMC in Noblesville, Ind. The thumb valve 240 will be secured near the cup holder 209 (FIG. 9B) of the armrest (e.g., armrest 178) or another part of the seat support assembly 144 that can be readily accessed by any viewer not interested in the water effect. A suitable thumb valve is the VHK-06F-06F from SMC in Noblesville, Ind.

FIG. 12 illustrates a flowchart of the process and hardware transmitting commands to the fans for control of the fluid delivery system of FIG. 11. In an embodiment, using known conventional techniques, the system can include a controller 280 that transmits a digital command to a programmable controller 282, which in turn transmits an analog voltage through a fuse 284 (optional), which in turn sends the analog voltage to an electrical relay 286 (optional) that sends an analog voltage to turn the fan on, set the flow rate, and turn the fan off. A suitable controller for the controller 280 in this process and hardware arrangement is the MediaMation MM-Showflow Controller that can be obtained from MediaMation Inc., in Torrance, Calif. A suitable programmable controller for the programmable controller 282 in this process and hardware arrangement is the MediaMation MX4D Control Box that can be obtained from MediaMation Inc., in Torrance, Calif. A suitable fuse for the fuse 284 and this process and hardware is the Konnect-It KN-F10L24DC fuse that can be obtained from Automation Direct in Cumming, Ga. A suitable relay for the electrical relay 286 is the Fujitsu FTR-LYCA024Y relay that can be obtained from Fujitsu Components America, Inc. San Jose, Calif.

As indicated in FIG. 12, one or more of the hardware components 280, 282, 284, and 286 can be omitted from the control process, but preferably all of these components are used to enhance control (e.g., controller 280 and relay 286) and safety (e.g., fuse 284) of the system. The controller 280 (e.g., personal computer) can run a program that transmits a set of digital commands on a serial port (e.g., Ethernet) to the programmable controller 282 that reads the digital command and converts them to an analog signal which is an input to the fan control 288 that determines whether the fan is on or off and, when on, the fan rpm. In an alternative embodiment, an operator can manually actuate the fans to achieve the desired effects.

In a preferred embodiment, a controller 280 will send a digital command over Ethernet to each programmable controller 282 that transmits an analog signal to each fan to vary fan rpm to produce the flow rate required to simulate the effect as required during the movie. For example, if the movie depicts a hurricane, the analog signal will be at a higher voltage that causes the fan to run at a higher rpm to generate a higher flow rate to simulate the hurricane. If the movie depicts a scene with a balmy breeze, the analog signal will be a lower voltage that causes the fan to run at a lower rpm to generate a lower flow rate. An operator can watch the movie and set the fan commands (e.g., off or on with high, medium, low flowrates) over the length of the movie to simulate what viewers would expect to experience if actually in the movie.

FIGS. 1-12 illustrate the fluid delivery systems and methods of fluid delivery in a four-seat support assembly. However, the inventors recognize the fluid delivery system may be implemented for one or more seats, and each seat may include one or more armrests. Furthermore, the system may be implemented by an operator rather than a controller (e.g., a network computer), which is also referred to as a central controller. It is also recognized that the system is not limited to seating designed for commercial theaters, theme parks, exhibits, home theaters, and gaming. For example, it may be used in any environment where fluid effect will enhance or change the experience of the viewer in the seat.

Thus, the systems and methods described also eliminate the need for hanging fans to produce in-theater effects such as wind. In addition, the system eliminates the need for rails mounted in front-row seats and water jets on the back of each additional row. Instead, the effects (e.g., air blasts, wind, water, mist and scents) are implemented at the armrest of the seat of the viewers. If the seat also moves, the effects move along with the viewer.

The design of the system allows unlimited configurations as to the number of seats, however, four seats in an assembly is a preferred arrangement. It also may provide each rider with the same experience at a relatively low cost. Many of the parts of the systems can be purchased and implemented in metal such as high strength steel, but the person of ordinary skill would readily understand the materials and parts to use after review of the specification. Further, the choice of materials and conventional parts is not essential to the invention.

What is claimed:

1. A system of fluid delivery for a seat system, comprising;

a seat support assembly;

a seat with an armrest, on the assembly, that includes an air, scent, and water outlet and a fan air outlet; and a fluid delivery system, including a controllable valve array with an air inlet and a first air valve outlet, a first scent tank spaced from the armrest, and a first scent line connecting the first air valve outlet to the first scent tank and an air nozzle outlet to deliver air and a first scent to the air, scent, and water outlet, and a fan system spaced from the armrest and coupled by a tube to supply air to the fan air outlet.

2. The system of claim 1, wherein the fluid delivery system further comprises a water valve with a water valve inlet and a water valve outlet, wherein a water line is connected from the water valve outlet to an air and/or water nozzle outlet to deliver water to the air, scent and water outlet.

3. The system of claim 2, wherein the fluid delivery system further comprises an atomizing air outlet in the controllable valve array, and an atomizing air line from the atomizing air outlet to the air and/or water nozzle outlet to deliver atomized air to the air, scent and water outlet.

4. The system of claim 1, wherein the controllable valve array further includes a second air valve outlet, a second scent tank separated from the armrest of the seat, and a second scent line connecting the second air valve outlet to the second scent tank and the air nozzle outlet to deliver air and a second scent to the air, scent, and water outlet.

5. The system of claim 1, further comprising a controller configured to communicate on and off commands that correspond to the start and end of each event on a timeline of a movie and to use the commands to actuate the controllable valve array and the fan system in accordance with each event of the movie timeline.

6. The system of claim 5, further comprising a programmable controller configured to receive digital commands from the controller and convert them to voltage signals to the fluid delivery system to actuate the controllable valve array to deliver air, scent, and/or water and to actuate the fan system to deliver air to a viewer in the seat in accordance with the movie timeline.

7. The system of claim 1, further comprising a compressor that supplies pressurized air to the air inlet of the controllable valve array.

8. The system of claim 2, further comprising a water pump to supply pressurized water to the water inlet of the water valve.

9. The system of claim 2, further comprising a shut-off valve on the water line downstream from the water valve to cut off water from being delivered to a viewer in the seat.

10. The system of claim 1, wherein a cross-sectional area of the air, scent, and/or water outlet is smaller than a cross-sectional area of the fan air outlet to deliver air, scent, and water at a lower flow rate than the air delivered from the fan air outlet to a viewer in the seat.

11. The system of claim 1, wherein the front end of the armrest includes a pin-hole shaped air, scent, and water outlet and a slot-shaped fan air outlet to direct air at a viewer in the seat.

12. The system of claim 1, wherein the fan air outlet includes a left slot and a right slot, wherein the tube is a Y-splitter that connects the left slot and the right slot of the fan air outlet to the fan system.

13. The system of claim 12, wherein the Y-splitter is a sound absorbing material and has a larger cross-sectional area than the left and right slots to reduce noise and resistance to the delivery of air to a viewer in the seat.

* * * * *